US006135308A

United States Patent [19]

Fang

[11] Patent Number: 6,135,308

[45] Date of Patent: Oct. 24, 2000

[54] BOSS FOR A FILAMENT WOUND PRESSURE VESSEL

[75] Inventor: Guang-Chyan Fang, Hsinchu, Taiwan

[73] Assignee: Industrial Technology Research Institute, Hsinchu, Taiwan

[21] Appl. No.: 09/105,792

[22] Filed: Jun. 26, 1998

[51] Int. Cl.[7] ..... F17C 1/06

[52] U.S. Cl. ..... 220/590; 220/588; 220/601; 220/661

[58] Field of Search ..... 220/587, 588, 220/590, 601, 661, 589, 4.13

[56] References Cited

U.S. PATENT DOCUMENTS 3,907,149 9/1975 Harmon ..... 220/590

5,383,566 1/1995 Johnson ..... 220/590 X 5,518,141 5/1996 Newhouse et al. ..... 220/590 X

*Primary Examiner*—Steven Pollard

*Attorney, Agent, or Firm*—W. Wayne Liauh

[57] ABSTRACT

An improvement of boss for a pressure vessel which has a plastic internal liner and a filament wound around outer shell and an opening at one end of the outer shell. The boss is made by pressing a metallic material and has a double wall neck projecting outwardly through the opening. The neck has an outside wall which extends radially at one end opposite the opening to form a flange embedded in the liner to form an air tight binding. The flange has an annular V-shaped notch ring in the upper surface and a plural number of protrusive stubs on the lower surface thereof to strength the binding with the liner for withstanding high pressure without leaking or rupture.

9 Claims, 2 Drawing Sheets

BOSS FOR A FILAMENT WOUND PRESSURE VESSEL

BACKGROUND OF THE INVENTION

1. Field of the Invention

This invention relates to a boss for filament wound pressure vessels and particularly to an improved boss for filament wound pressure vessels that can withstand high pressure without leaking.

2. Description of the Prior Art

Pressure vessel of various types have been widely used in many applications. Propane gas tanks used as fuel storage in households, oxygen gas tanks used in laboratories and high pressure tanks used in the airplanes are but a few examples. A pressure vessel has to employ special structure, materials and design to withstand high fluid pressure without leaking. To meet this requirement, a conventional pressure vessel usually has a plastic liner, a filament wound outershell wrapping around the plastic liner, and a metallic boss. The metallic boss generally has a tubular neck and an annular flange engaging with the interior surface of the plastic to form a sturdy structure to withstand high internal pressure. The metallic boss requires substantial amounts of machining work. It is time consuming to make and is expensive.

U.S. Pat. No. 5,429,845 (Newhouse et al.) discloses a metallic boss which has an annular attachment flange with a skewed annular locking groove formed in the inner surface or outer surface of the attachment flange. While it may enhance the strength to support high pressure, it needs a great deal of machining work. It therefore costs higher.

U.S. Pat. No. 5,568,878 (Le Brefon) discloses another reinforced access opening for filament wound pressure vessel. It has a metallic cylindrical reinforcement member and a supporting flange at one end engaging with an annular face of the liner flange, and a radially extending supporting foot at its other end which contacts a mating outer surface of the liner. It has a sharp angle at one end of the supporting foot while another end of the supporting end is tapering off. The sharp angle could cause liner rupture under high pressure while the tapering end cannot form a strong binding with the liner and the outershell. Its resistance to high pressure is thus questionable.

SUMMARY OF THE INVENTION

In view of aforesaid disadvantages of prior art pressure vessels, it is therefore an object of this invention to provide a boss for a filament wound pressure vessel that can reinforce the supporting strength of the access opening and can be made easily by means of low cost machining work.

The metallic boss according to this invention has a double wall at the neck portion and a support flange extending radially in a smooth angle from a bottom of a neck wall to engage with the liner. The boss thus has much stronger supporting power at the access opening and can also withstand higher internal pressure of the vessel.

In another aspect of this invention, the support flange may further have an annular V-shaped notch ring in an upper surface and a plural number of protrusive stubs on a lower surface so that the support flange may form a strong binding with the liner to sustain higher pressure.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1A:
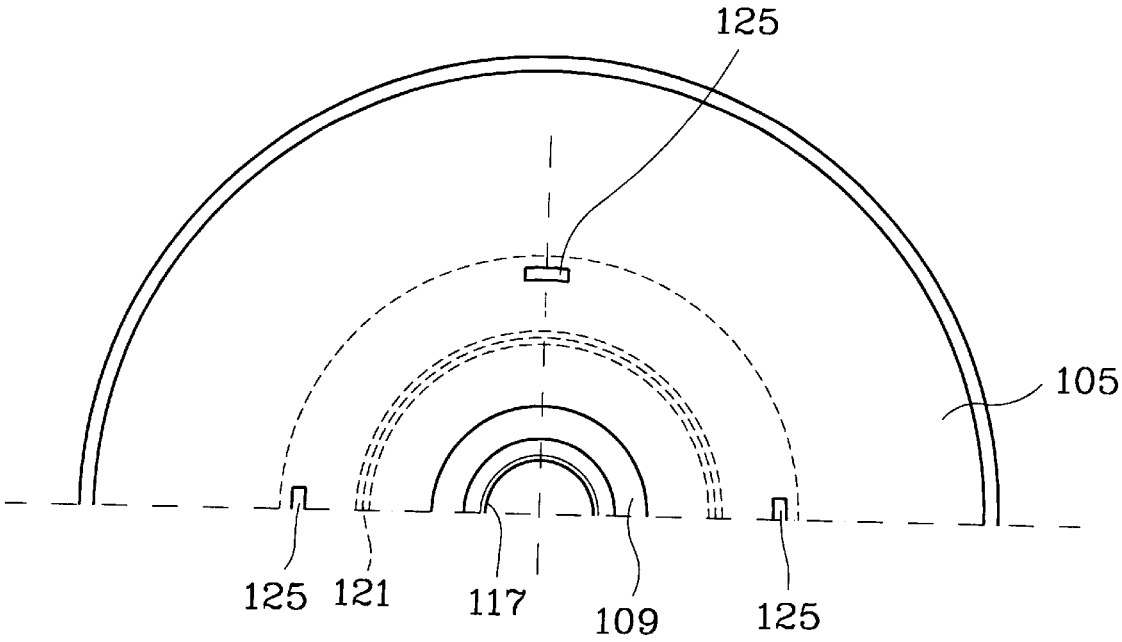
FIG. 1A is a fragmentary top view of this invention.
Figure 1B:
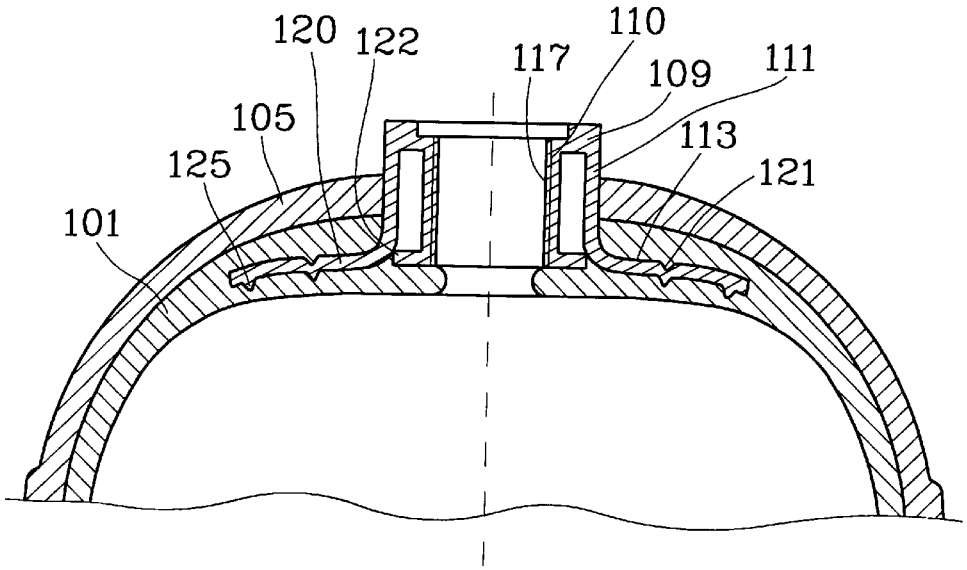
FIG. 1B is a sectional view of a first embodiment of this invention.

Referring to FIG. 1B for the first embodiment of this invention, the pressure vessel has a two-layer body which has a plastic liner 101 and a filament wound outer shell 105 covering the outside surface of the liner 101. There is an access opening at one end of the vessel and with a metallic boss 109 disposed therein. The boss 109 has a double wall neck portion 110 and 111. The inside wall 110 of the neck portion has a screw threads 117 formed therein for engaging with other piping system or instruments (not shown in the figure). The inside wall 110 at the end toward the vessel forms an annular second flange 122 extending radially outward. The outside wall 111 of the neck portion turns radially outward near the second flange 122 and forms an annular first flange 120 which is also extending radially outward. In the upper surface of the first flange 120, there is formed an annular V-shaped notch ring 121. On the lower surface of the first flange 120, there are formed a plural number of spaced protrusive stubs 125 (also shown in FIG. 1A). The first flanges 120 is embedded in the liner 101. With the aids of the V-shaped notch ring 121 and protrusive stubs 125, the first flange 120, and the boss 109 is provided with a strong binding with the liner 101 to withstand high internal pressure existing in the interior of the liner 101. It can also enhance sealing effect to prevent leakage. The upper surface of the first flange 120 may be covered with a plastic sheet 113 to further enhancing its binding force with the liner 101.

The double wall boss 109 and the V-shaped notch ring 121 and the protrusive stubs 125 can be easily formed by pressing or stamping process. It can be mass produced at low cost. The double wall boss structure has high strength to support connection with other piping system or instruments. The smooth turning of the first flange from the neck portion can form a strong binding with the liner to sustain high internal pressure.

Figure 2:
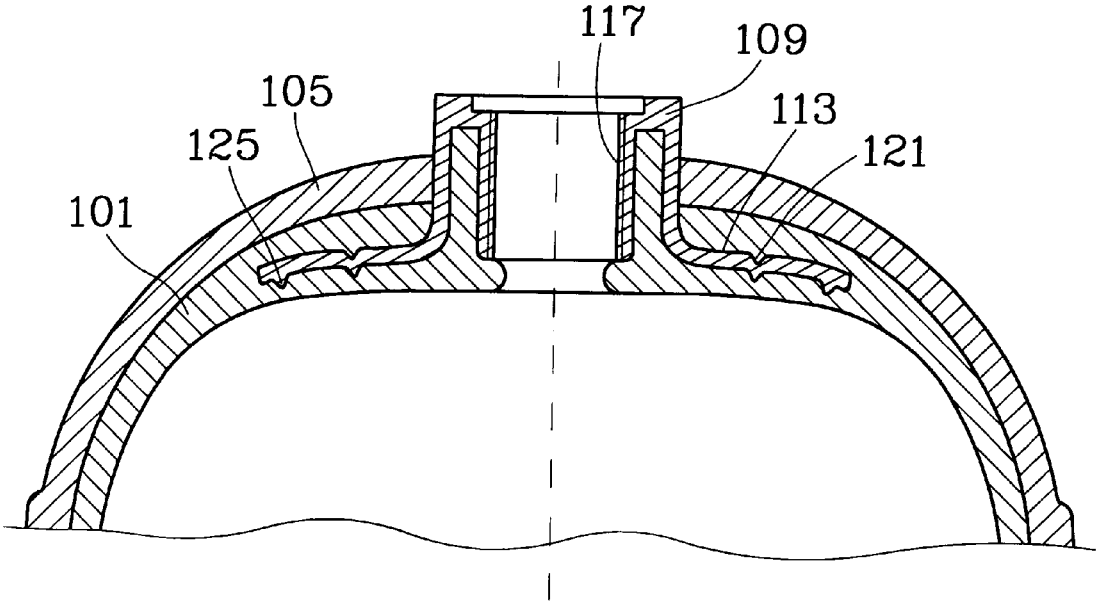
FIG. 2 is a sectional view of a second embodiment of this invention.

FIG. 2 shows a second embodiment of this invention. It is generally constructed like the first embodiment shown in FIG. 1B except that the second flange 122 is dispensed with. The liner 101 thus may fill in the space formed between the inside wall 110 and outside wall 111 to form a strong structure at the neck portion of the boss 109.

It may thus be seen that the objects of the present invention set forth herein, as well as those made apparent from the foregoing description, are efficiently attained. While the preferred embodiments of the invention have been set forth for purpose of disclosure, modifications of disclosed embodiments of the invention as well as other embodiments thereof may occur to those skilled in the art. Accordingly, the appended claims are intended to cover all embodiments which do not depart from the spirit and scope of the invention.

What is claimed is:

1. A boss for a pressure vessel having a plastic internal liner and a filament wound around an outer shell, comprising:

a tubular double wall neck projecting outwardly through an opening in the outer shell, the neck having an inside tubular wall connecting with an outside tubular wall at the opening and both the inside tubular wall and the outside tubular wall terminate at an interior of the liner, the outside tubular wall having an annular first flange formed at one end opposite of the opening and being embedded in the liner;

wherein the first flange is substantially planar in shape and has an annular V-shaped notch ring formed in an upper surface thereof; and the first flange also has a plurality of spaced protrusive stubs formed on a lower surface thereof.

2. The boss for a pressure vessel of claim 1 which further has a plastic sheet covering the upper surface of the first flange.

3. The boss for pressure vessel of claim 1 wherein the boss is formed by pressing a metallic material.

4. A boss for a pressure vessel having a plastic internal liner and a filament wound around outer shell, comprising:

a tubular double wall neck projecting outwardly through an opening in the outer shell, the neck having an inside tubular wall connecting with an outside tubular wall at the opening and both the inside tubular wall and the outside tubular wall terminate at an the interior of the liner, the outside tubular wall having an annular first flange formed at one end opposite to the opening and being embedded in the liner, the inside wall further having an annular second flange formed radially at one end opposite of the opening;

wherein the first flange is substantially planar in shape and has a plurality of spaced protrusive stubs formed on a lower surface thereof; and the first flange also has an annular V-shaped notch ring formed in an upper surface thereof.

5. The boss for a pressure vessel of claim 4 which further has a plastic sheet covering the upper surface of the first flange.

6. The boss for pressure vessel of claim 4 wherein the boss is formed by pressing a metallic material.

7. A pressure vessel comprising:

a plastic internal liner, an outer shell, and a filament wound around the outer shell, a boss made by pressing a metallic material having a tubular double wall neck projecting outwardly through an opening in the outer shell, the neck having an inside tubular wall connecting with an outside tubular wall at the opening and both the inside tubular wall and the outside tubular wall terminate at an interior of the liner, the outside tubular wall having an annular first flange formed at one end opposite to the opening and being embedded in the liner;

wherein the first flange is substantially planar in shape and has an annular V-shaped notch ring formed in an upper surface thereof; and the first flange also has a plurality of spaced protrusive stubs formed on a lower surface thereof.

8. The pressure vessel of claim 7 wherein the inside wall further having an annular second flange formed radially at one end opposite to the opening.

9. The pressure vessel of claim 7 wherein the boss is formed by pressing a metallic material.

* * * * *